US005845359A

United States Patent [19]

Weiss

[11] Patent Number: 5,845,359

[45] Date of Patent: Dec. 8, 1998

[54] PAINT AND COATINGS APPLICATOR

[75] Inventor: Sherman L. Weiss, Sun Valley, Calif.

[73] Assignee: Great American Marketing, Inc., Sun Valley, Calif.

[21] Appl. No.: 939,195

[22] Filed: Sep. 29, 1997

[51] Int. Cl.[6] ..... B05C 17/02

[52] U.S. Cl. ..... 15/114; 15/105; 15/230.11; 15/248.2

[58] Field of Search ..... 15/105, 111, 117, 15/114, 118, 121, 230.11, 248.2

[56] References Cited

U.S. PATENT DOCUMENTS

| | | | |
|---|---|---|---|
| 2,225,517 | 12/1940 | Barker | 15/114 X |
| 3,085,270 | 4/1963 | Vosbikian et al. | 15/230.11 X |
| 3,115,659 | 12/1963 | Church | 15/230.11 |
| 3,274,637 | 9/1966 | Schulze | 15/230.11 X |
| 3,346,899 | 10/1967 | Murphy | 15/230.11 X |
| 3,378,872 | 4/1968 | Frontera et al. | 15/230.11 |
| 4,985,958 | 1/1991 | Garcia | 15/230.11 X |
| 5,014,384 | 5/1991 | Brezette et al. | 15/230.11 |

FOREIGN PATENT DOCUMENTS

| | | | |
|---|---|---|---|
| 887294 | 1/1962 | United Kingdom | 15/230.11 |
| 954819 | 4/1964 | United Kingdom | 15/114 |

*Primary Examiner*—Mark Spisich

*Attorney, Agent, or Firm*—Marshall A. Lerner, Esq.; Bradford E. Mattes, Esq.; Kleinberg & Lerner, LLP

[57] ABSTRACT

An applicator for paint and coatings includes a housing, roller, brush, spreader, and handle. The roller, brush, and spreader are positioned on the housing so that they can each be used independently of one another and so that any combination of them can be engaged at any time while the applicator is in use.

4 Claims, 2 Drawing Sheets

PAINT AND COATINGS APPLICATOR

BACKGROUND

This invention is a device for applying paint, stain, sealers, clear finishes, waterproofing materials or the like and includes a roller, a brush, and a spreader.

A number of prior art devices use a roller combined in various ways with a brush to apply these materials. Unlike the present invention, however, none of the prior art devices have ever incorporated a brush with a roller in such a way that the mode of operation could be switched from roller to brush, or vice verse, with minimal effort and while the device is in use.

Nor have any of the prior art devices ever incorporated a spreader with the roller. The spreader is combined with the roller and brush in such a way that the roller, brush or spreader can be selected and engaged with minimal effort and while the device is in use.

U.S. Pat. No. 756,695 to Peterson discloses a liquid distributer and has an adjustable brush. However, it is mounted in such a way that its range of adjustment does not allow the user to apply materials in a brush-only mode.

The paint applicator disclosed in U.S. Pat. No. 3,085,270 to Vosbikian et al. can be used in a brush-only or roller-only mode. However, its modes of operation cannot be changed while the device is in use. In order to switch the Vosbikian device from one such mode to another, the user must stop applying the materials and manually adjust the brush to switch it to another position.

Each of the foregoing prior art devices is unnecessarily complicated by the use of moving parts to enable each device's modes of operation to be changed.

In light of the foregoing shortcomings in the prior art, a paint and coatings applicator is needed with minimal moving parts that will allow the user to select and engage the roller, brush, or spreader automatically and while the applicator is in use.

SUMMARY

The present invention eliminates the shortcomings of the prior art and satisfies the needs identified above. This is achieved by incorporating a brush and spreader as integral parts of the roller's housing.

A preferred version of the improved paint and coatings applicator of the present invention (also referred to herein as "applicator") comprises:

(a) a roller;

(b) a housing partially surrounding the roller;

(c) a handle, a brush and a spreader attached to the housing and oriented such that the roller, brush, and spreader may each be used independently and being further oriented such that operating modes may be selected and engaged while the applicator is in use.

DRAWINGS

These and other features and advantages of the present invention will be better understood by referring to the following description, claims, and accompanying drawings in which:

DESCRIPTION

Figure 3:
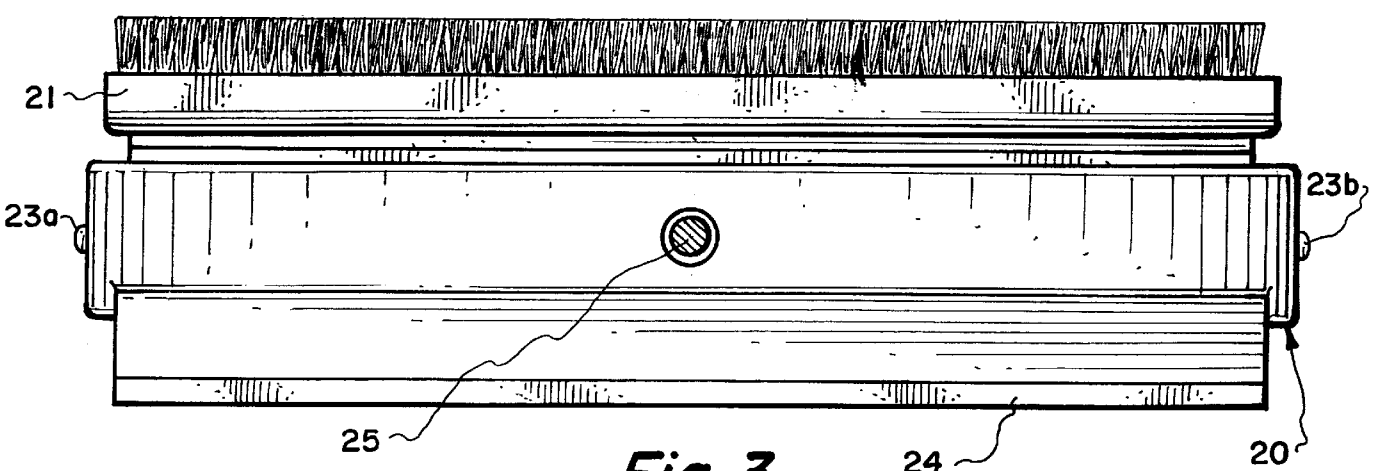
FIG. 3 is a top view of FIG. 2.
Figure 4:
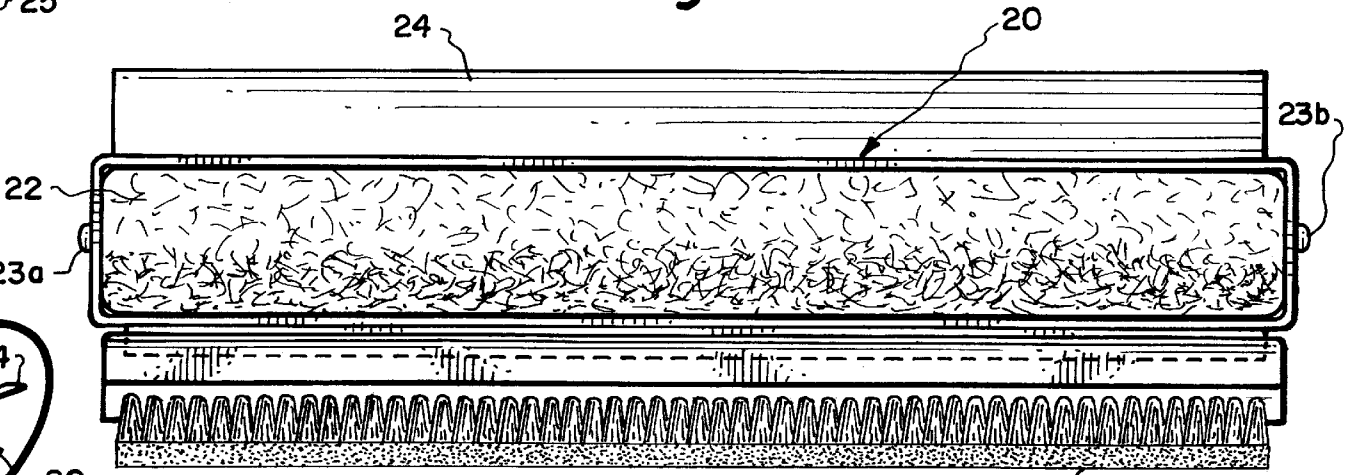
FIG. 4 is a bottom view of FIG. 2.
Figure 1:
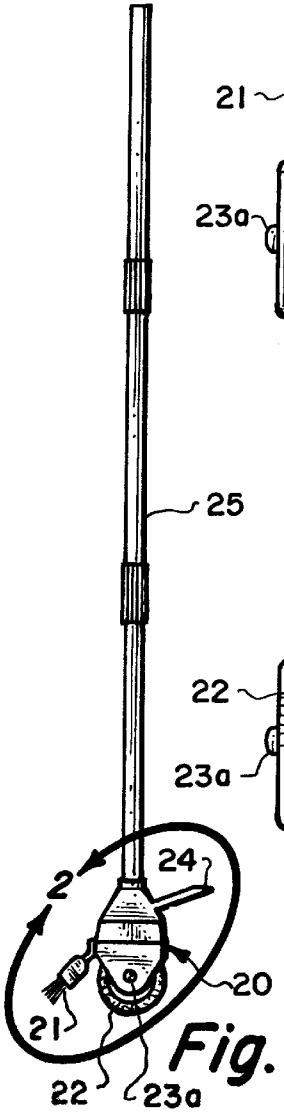
FIG. 1 is a side view of the applicator.
Figure 5:
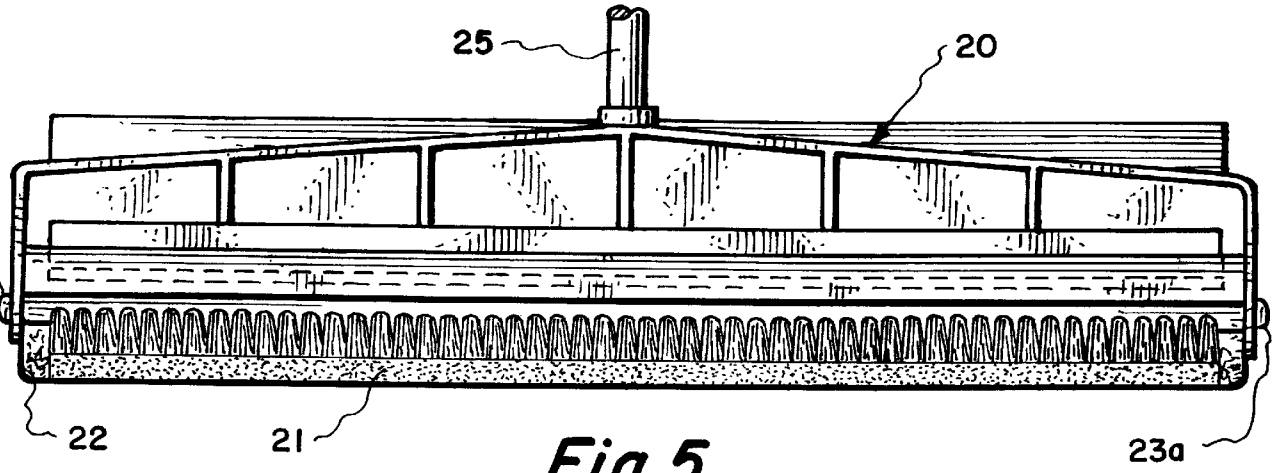
FIG. 5 is a front view of FIG. 2.
Figure 6:
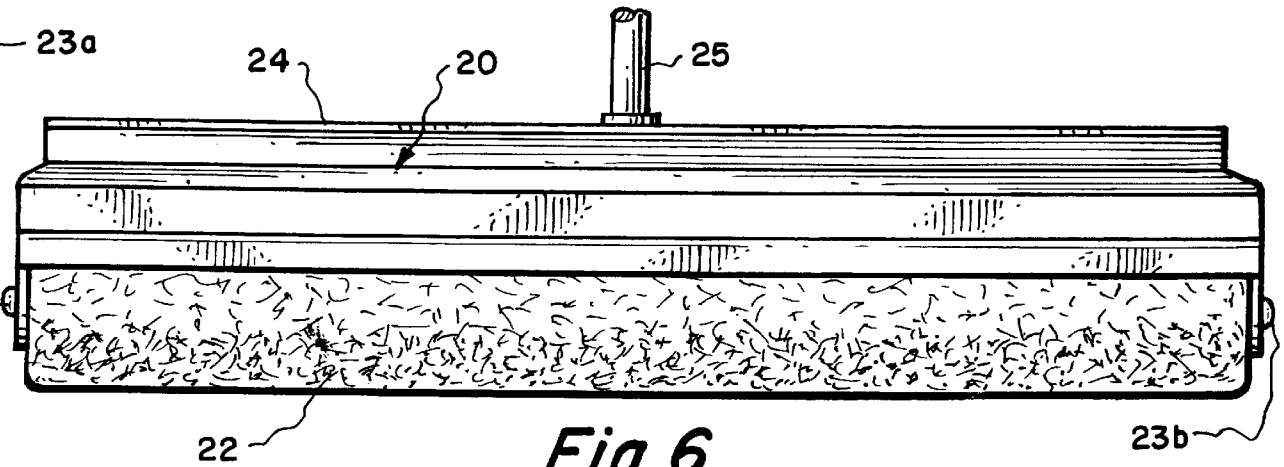
FIG. 6 is a rear view of FIG. 2.
Figure 2:
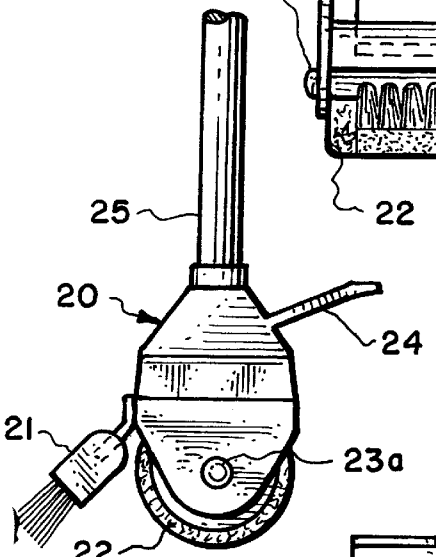
FIG. 2 is an enlarged side view taken on line 2 of FIG. 1.

As shown in FIGS. 1 and 2, the improved paint and coatings applicator comprises a housing 20 to which is attached a roller 22, a brush 21, a spreader 24, and a handle 25. The handle 25 is sufficiently long to allow a person to use the applicator without bending over. The handle 25 can be made of wood, metal, plastic or other relatively rigid material. It can also be made in sections, each approximately the length of the housing, that can be assembled to any desired length and then disassembled for more compact storage of the paint and coatings applicator.

The housing 20 provides means for attaching the roller 22, brush 21, and spreader 24 to the handle 25 in such a manner that the user can select and engage any one of those modes of operation while the device is in use. The housing 20 also acts as a splash guard for liquid that is thrown off the roller when the roller is rotated.

The roller is sufficiently wide for use on floors, decks, roofs, driveways and the like. The roller is attached to the housing via pins 23*a* and 23*b* rigidly mounted in each end of the housing and roller which allow the roller to rotate. As shown in FIGS. 1 and 2, the roller is oriented with respect to the brush and spreader in such a way that it can be used independently of either the brush or spreader.

The brush 21 spans the length of the housing and it can be permanently or removably attached to the housing. As shown in FIGS. 1 and 2, the brush is oriented with respect to the roller and spreader in such a way that it can be used independently of either the roller or spreader. The brush is also helpful for pushing paint or coating into pores of the surface which is to be painted or coated.

The spreader 24 also spans the length of the housing. It can be made of any rigid or flexible material including hard plastic or soft rubber. The spreader is oriented with respect to the roller and brush in such a way that it can be used independently of either the roller or brush.

The user can select and engage the desired mode of operation, i.e., roller, brush, or spreader, by holding the handle at a certain range of angles with respect to the surface being painted or coated. For example, when the handle is at 0 degrees with respect to the work surface and the spreader is in contact with the work surface, the spreader can be used at handle-to-work-surface angles of approximately 0 to 45 degrees without engaging the roller or brush. When this angle is in the range of approximately 45 degrees to 110 degrees, the roller is engaged. When this angle is in the range of approximately 110 degrees to 180 degrees, the brush is engaged. Alternatively, when the roller or spreader is being used, the brush can be selected and engaged by simply raising the applicator above the work surface, rotating the handle 180 degrees about its longitudinal axis, and lowering the applicator to engage the brush with the work surface. The roller or spreader can be re-engaged by simply rotating the handle again in a like manner.

Each of the three modes of operation, i.e., roller, brush, or spreader, can be operated with respect to the user in a push-only, pull-only, or push and pull manner.

The spreader and brush can also be mounted on the housing in such a way that their orientation with respect to the housing is adjustable.

Each version of the present invention described above has many advantages. The orientation of the brush and spreader with respect to the roller allows any one of those three components to be used independently of the other while at the same time allowing the user to quickly and effortlessly change the method of operation from any one component to any other component.

Although the present invention has been described in detail with reference to certain preferred versions, other versions are possible. For example, the handle or housing could be modified to allow the paint or coating to be automatically dispensed while it is being applied by the roller, brush, or spreader. Also, the roller, brush or spreader can be made so that each one is independently replaceable. Accordingly, the spirit and scope of the following claims should not be limited to the description of the versions referenced herein.

What is claimed is:

1. A paint and coatings applicator for providing roller, brush, and spreader modes of operation and comprising;

(a) a roller having first and second opposite ends;

(b) a housing partially surrounding said roller and rotatably attached to said roller at said first and second opposite ends of said roller;

(c) a handle attached to an upper portion of said housing;

(d) a brush attached to said housing between the axis of rotation of the roller and the handle such that it is substantially parallel to said roller; and (e) a spreader attached to said housing between the axis of rotation of the roller and the handle such that it is substantially parallel to said roller wherein said modes of operation can be switched between and among said roller, brush or spreader while the applicator is in use and wherein the brush and spreader extend from the housing in generally opposite directions.

2. The paint and coatings applicator of claim 1 wherein the roller is removably attached to said housing.

3. The paint and coatings applicator of claim 1 wherein the brush is removably attached to said housing.

4. The paint and coatings applicator of claim 1 wherein the spreader is removably attached to said housing.

* * * * *